US012799827B2

(12) United States Patent
Zhao et al.

(10) Patent No.: US 12,799,827 B2
(45) Date of Patent: Nov. 17, 2026

(54) DOWNHOLE CLOSED-LOOP ANTI-TILTING TOOL

(71) Applicants: China National Petroleum Corporation, Beijing (CN); CNPC XiBu Drilling Engineering Company Limited, Xinjiang (CN)

(72) Inventors: Jibin Zhao, Urumqi (CN); Ming Yi, Urumqi (CN); Dongyu Qiao, Urumqi (CN); Yong Dai, Urumqi (CN); Feiyue Wang, Urumqi (CN); Cangjian Shang, Urumqi (CN); Zhi Wu, Urumqi (CN); Ruiqiang Tian, Urumqi (CN); Haifeng Zhou, Xinjiang (CN)

(73) Assignees: China National Petroleum Corporation, Beijing (CN); CNPC XiBu Drilling Engineering Company Limited, Xinjiang (CN)

( * ) Notice: Subject to any disclaimer, the term of this patent is extended or adjusted under 35 U.S.C. 154(b) by 0 days.

(21) Appl. No.: 19/472,006

(22) PCT Filed: Dec. 8, 2023

(86) PCT No.: PCT/CN2023/137526
§ 371 (c)(1),
(2) Date: Oct. 2, 2025

(87) PCT Pub. No.: WO2025/055164
PCT Pub. Date: Mar. 20, 2025

(65) Prior Publication Data

US 2026/0243133 A1 Aug. 20, 2026

(30) Foreign Application Priority Data

Sep. 15, 2023 (CN) ..... 202311198852.1

(51) Int. Cl.
*E21B 7/10* (2006.01)

(52) U.S. Cl.
CPC ..... *E21B 7/10* (2013.01)

(58) Field of Classification Search
CPC ..... E21B 7/10
See application file for complete search history.

(56) References Cited

U.S. PATENT DOCUMENTS 5,603,386 A * 2/1997 Webster ..... E21B 44/005 175/45
2007/0235227 A1 10/2007 Kirkhope et al.
(Continued)

FOREIGN PATENT DOCUMENTS

CN 2895695 5/2007
CN 101802343 8/2010
(Continued)

OTHER PUBLICATIONS

International Search Report and Written Opinion of PCT Application No. PCT/CN2023/137526, issued on Jan. 23, 2025, 17 pages of ISRWO.

*Primary Examiner* — Steven A Macdonald
(74) *Attorney, Agent, or Firm* — Volpe Koenig

(57) ABSTRACT

A downhole closed-loop anti-tilting tool includes a housing; a rotating impeller and hydraulic pump; recessed parts spaced circumferentially on the housing's outer surface; a plunger and push plate; and multiple hydraulic flow paths arranged circumferentially in the housing, each path communicating the pump with a corresponding recessed part. An eccentric flow-dividing disc lies across the flow paths. The disc's outer circumference has a notch permitting one flow path to open, with the notch and the disc's center of gravity located opposite each other. The disc rotates about the axis. When the housing becomes inclined, gravity turns the disc so the notch moves to a higher position and the center of gravity to a lower position, thereby connecting one hydraulic flow path and disconnecting the others. The associated
(Continued)

plunger and push plate then move radially outward. The tool contains no electronic components, and functions in all temperature wells.

15 Claims, 7 Drawing Sheets

(56) References Cited

U.S. PATENT DOCUMENTS

| | | | | |
|---|---|---|---|---|
| 2009/0114451 | A1 | 5/2009 | Wenzel | |
| 2010/0163311 | A1 | 7/2010 | Tulloch et al. | |
| 2014/0262507 | A1* | 9/2014 | Marson | G01D 5/145 175/325.1 |
| 2017/0198525 | A1 | 7/2017 | Feddema et al. | |
| 2019/0169935 | A1* | 6/2019 | Spatz | E21B 7/067 |
| 2019/0186253 | A1* | 6/2019 | Peter | E21B 47/024 |
| 2019/0323333 | A1* | 10/2019 | Ellis | E21B 47/024 |
| 2023/0142178 | A1* | 5/2023 | Williams | E21B 7/067 166/321 |

FOREIGN PATENT DOCUMENTS

| | | |
|---|---|---|
| CN | 104314470 | 1/2015 |
| CN | 104594804 | 5/2015 |
| CN | 107965279 | 4/2018 |
| CN | 113653446 | 11/2021 |

* cited by examiner

DOWNHOLE CLOSED-LOOP ANTI-TILTING TOOL

CROSS REFERENCE TO RELATED APPLICATIONS

The present application claims the benefits of Chinese Patent Application No. 202311198852.1 filed on Sep. 15, 2023, the content of which is incorporated herein by reference.

FIELD

The present disclosure relates to the field of steerable drilling instruments in the petroleum and well-drilling industry, in particular to a downhole closed-loop anti-tilting tool.

BACKGROUND

In the world, vertical wells account for 60% of drilled wells. As the exploration and development field is expanded continuously, the workloads of exploration and development of strata having high-steep structures and high dip angles have become increasingly higher, and the problem of anti-tilting and straightening has become more and more prominent. In the drilling process, anti-tilting and straightening is always a complex and urgent problem. At present, active and passive methods are mainly used for anti-tilting and straightening.

Passive technical measures for anti-tilting and straightening include combinations of tower drilling tools, pendulum drilling tools, high-rigidity drilling tools, off-axis drilling and single-bent PDM drilling tools and other drilling tools. In the case that the formation deflecting force is not high, efficient drilling can be achieved and well deviation can be effectively controlled by using tower drilling tools, pendulum drilling tools and other anti-tilting drilling tools in combination, measuring the deflection while drilling, and adjusting parameters timely. In the case that the formation deflecting force is high, only certain well deflection can be stabilized but the tilting reduction effect is not satisfactory no matter which combination of anti-tilting drilling tools is used.

Active measures for anti-tilting and straightening mainly refer to using vertical drilling tools to achieve the drilling goal. At present, most vertical drilling tools at home and abroad are in integrated electromechanical and hydraulic designs. Such designs are characterized in a high anti-tilting and straightening effect and high control accuracy. However, such drilling tools have complex structures and high costs. Besides, with the development of deep and extra-deep well drilling techniques, the downhole temperature is increased to 175° C. or even above 200° C. Owing to the limited temperature endurance of electronic devices, the failure rate of vertical drilling tools has greatly increased! These drilling tools can't meet the requirements for anti-tilting during drilling.

SUMMARY

The object of the present disclosure is to overcome the problem that the anti-tilting tools for drilling in the prior art can't withstand downhole high-temperature environments.

In order to attain the object described above, the present disclosure provides a downhole closed-loop anti-tilting tool, which comprises:

a housing, with two ends that can be connected with a drill stem and a drill bit respectively;

a rotating impeller that is arranged in the housing and can be driven by the drilling fluid to rotate;

a hydraulic pump that is arranged in the housing and connected in transmission to the rotating impeller;

recessed parts circumferentially arranged at intervals on an outer circumference of the housing;

a plunger movably arranged in the recessed parts and a push plate arranged on an outer surface of the plunger;

a plurality of hydraulic flow paths circumferentially arranged at intervals in the housing, the plurality of hydraulic flow paths respectively communicating the hydraulic pump and each recessed part;

and an eccentric flow dividing disc disposed on the plurality of hydraulic flow paths, an outer circumference of the eccentric flow dividing disc being provided with a notch allowing one of the hydraulic flow paths to be communicated, the center of gravity and the notch of the eccentric flow dividing disc being respectively located on two sides of a central axis, and the eccentric flow dividing disc being capable of rotating around the central axis;

wherein when the housing is inclined, the eccentric flow dividing disc rotates to a state in which the notch is located at a higher position and the center of gravity is located at a lower position, so as to connect to one of the hydraulic flow paths and disconnect the other hydraulic flow paths, so that the plunger and the push plate corresponding to the connected hydraulic flow path are driven to move outward radially.

In some embodiments, the downhole closed-loop anti-tilting tool further comprises a nonmagnetic outer cylinder and a driving shaft that is rotatably arranged in the nonmagnetic outer cylinder and connected in transmission to the hydraulic pump, wherein the rotating impeller is rotatably sleeved on the nonmagnetic outer cylinder, and the driving shaft is magnetically coupled with the rotating impeller.

In some embodiments, an upper end of the non-magnetic outer cylinder is connected with a conical-head rod.

In some embodiments, an upper inner alloy ring is sleeved on an upper part of the nonmagnetic outer cylinder and a lower inner alloy ring is sleeved on a lower part of the nonmagnetic outer cylinder; an upper outer alloy ring that can be rotatably sleeved on the upper inner alloy ring is provided at an upper end of the rotating impeller and a lower outer alloy ring that can be rotatably sleeved on the lower inner alloy ring is provided at the lower end of the rotating impeller.

In some embodiments, an upper end of the driving shaft is mounted on the nonmagnetic outer cylinder via a sliding bearing, and a lower end of the driving shaft is mounted on the nonmagnetic outer cylinder via a lower bearing.

In some embodiments, the housing comprises an upper outer cylinder, an oil storage cylinder and a rubber sleeve sleeved on the oil storage cylinder are arranged in the upper outer cylinder, an annular hydraulic oil cavity is formed between the rubber sleeve and the oil storage cylinder, and the hydraulic oil cavity is in communication with each of the hydraulic flow paths.

In some embodiments, an annular step is formed on a lower part of the upper outer cylinder, inlets corresponding to the plurality of hydraulic flow paths are arranged on the annular step, and the eccentric flow dividing disc is arranged between a lower end of the oil storage cylinder and the annular step.

In some embodiments, a pump end connector, a commutation connector and a bypass connector are arranged between the hydraulic pump and the oil storage cylinder, and the hydraulic pump and the oil storage cylinder are in communication with each other through a main flow path arranged in the pump end connector, the commutation connector and the bypass connector.

In some embodiments, the downhole closed-loop anti-tilting tool further comprises a central axle connected to the lower end of the upper outer cylinder, and a lower outer cylinder rotatably sleeved on the central axle, and the lower outer cylinder is provided with the recessed part.

In some embodiments, the downhole closed-loop anti-tilting tool further comprises an inner sleeve fixedly sleeved on the central axle and an upper oil seal housing rotatably sleeved on the inner sleeve via a sleeve bearing, wherein an upper end of the lower outer cylinder is fixedly sleeved on the upper oil seal housing, and the hydraulic flow paths are provided in the central axle, the inner sleeve, and the lower outer cylinder.

In some embodiments, an upper lubricating oil cavity at an upper side of the sleeve bearing is formed between the upper oil seal housing and the inner sleeve.

In some embodiments, a flow-dividing ring is arranged between the upper oil seal housing and the lower outer cylinder, a plurality of radial flow paths arranged axially at intervals are provided in the flow-dividing ring, and the plurality of radial flow paths are in communication with each of the hydraulic flow paths in one-to-one alignment.

In some embodiments, stop blocks are respectively provided at an upper end and a lower end of the recessed part, and a radially retractable stop spring is provided between the stop block and the push plate; and/or a composite spring is provided between the push plate and the plunger.

In some embodiments, a lower end of the central axis is connected with a lower connector, a lower oil seal housing is sleeved on an upper part of the lower connector, and a lower lubricating oil cavity is formed between the lower oil seal housing and the lower connector.

In some embodiments, wear-resistant bosses are arranged on two end faces of the eccentric flow dividing disc; and/or the eccentric flow dividing disc is provided with an eccentric hole.

With the above-mentioned technical scheme, the downhole high-pressure fluid is distributed and the plunger action is controlled by means of the automatic rotation of the downhole eccentric flow dividing disc under the action of gravity, so as to realize closed-loop automatic operation; different from existing integrated electromechanical anti-tilting tools, the entire tool set has no electronic component, is not subjected to temperature limitation, and can fully adapt to normal temperature, high temperature and ultra-high temperature well environments; besides, the manufacturing cost of the tool is greatly reduced since electronic components are reduced; the downhole closed-loop anti-tilting tool has the characteristics of low cost and convenient maintenance while meeting downhole closed-loop anti-tilting requirements during drilling.

REFERENCE NUMERALS

Figure 1:
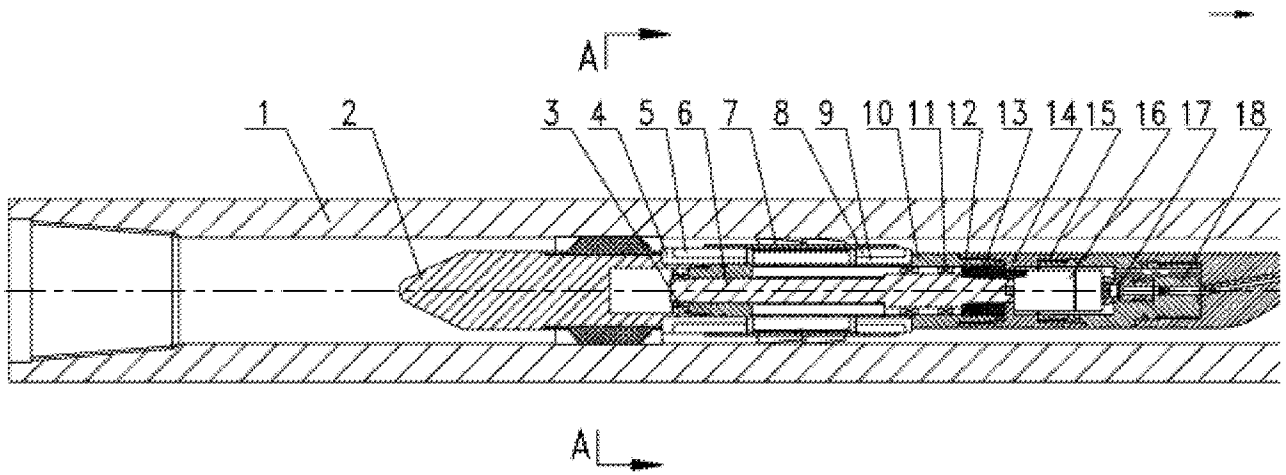
FIGS. 1 to 4 are cross-sectional views of the downhole closed-loop anti-tilting tool through the center axis at various positions according to the embodiments of the present scheme.

1—upper outer cylinder; 2—conical-head rod; 3—sliding bearing; 4—upper inner alloy ring; 5—upper outer alloy ring; 6—driving shaft; 7—rotating impeller; 8—lower outer alloy ring; 9—lower inner alloy ring; 10—nonmagnetic outer cylinder; 11—lower bearing; 12—disc spring; 13—compression rubber spring; 14—screw; 15—adapter; 16—hydraulic pump; 17—pump end connector; 18—commutation connector; 19—bypass connector; 20—upper fixed sleeve; 21—oil storage cylinder; 22—anti-impact sleeve; 23—screw; 24—rubber sleeve; 25—lower fixed sleeve; 26—eccentric flow dividing disc; 27—sealing plug; 28—rectangular ring; 29—central axle; 30—inner sleeve; 31—upper oil seal ring; 32—upper oil seal housing; 33—tapered plug; 34—sleeve bearing; 35—oil-separating rubber ring; 36—lower outer cylinder; 37—flow-dividing ring; 38—stop block; 39—orifice plate; 40—bolt; 41—stop spring; 42—plunger; 43—composite spring; 44—push plate; 45—anti-drop ring; 46—sealing rubber ring; 47—lower oil seal housing; 48—oil seal ring; 49—lower connector.

DETAILED DESCRIPTION

The embodiments of the present disclosure will be further described below in detail in examples with reference to the accompanying drawings. The following detailed description of the examples and drawings are used to illustrate the principle of the present disclosure, but are not intended to limit the scope of the present disclosure. The present disclosure can be implemented in many different forms, is not limited to the specific examples disclosed herein, but includes all technical schemes falling within the scope of the claims.

These examples are provided to make the present disclosure understood thoroughly and completely, and fully convey the scope of the present disclosure to those skilled in the art. It may be noted: unless otherwise specified, the relative arrangement of components and steps, the compositions of materials, numerical expressions and numerical values set forth in these examples may be interpreted as merely illustrative rather than limiting.

It may be noted: in the description of the present disclosure, unless otherwise specified, the term "a plurality" means two or more; the orientational or positional relations indicated by terms "top", "bottom", "left", "right", "inside" and "outside", etc. are used only to ease and simplify the description of the present disclosure, rather than indicating or implying that the involved device or component may have a specific orientation or may be constructed and operated in a specific orientation. Therefore, the use of these terms shall not be deemed as constituting any limitation to the present disclosure. Once the absolute position of the described object is changed, the relative positional relationship may also change accordingly.

In addition, the words "first", "second" and the like used in the present disclosure do not indicate any order, quantity or importance, but are only used to distinguish different parts. "Perpendicular" is not perpendicular in the strict sense, but is within an allowable range of error. "Parallel" is not parallel in the strict sense, but is within an allowable range of error. The word "comprise", "include" or the like means that the element set forth before the word encompasses the elements set forth after the word, and does not exclude the possibility of encompassing other elements.

In addition, it may be noted: in the description of the present disclosure, unless otherwise specified and defined explicitly, the terms "install", "interconnect", and "connect", etc. shall be interpreted in their general meanings, for example, a connection may be a fixed connection, detachable connection, or integral connection; or may be a direct connection or indirect connection via an intermediate medium. Those having ordinary skills in the prior art may comprehend the specific meanings of the terms in the present disclosure in their contexts. When it is mentioned that a specific component is located between a first component and a second component, an intermediate device may or may not exist between the specific device and the first device or the second device.

All terms used in the present disclosure have the same meanings generally understood by those having ordinary skill in the art to which the present disclosure belongs, unless otherwise defined. It may also be understood that the terms defined in, for example, general dictionaries may be interpreted as having meanings consistent with their meanings in the contexts of related arts, and may not be interpreted in an idealistic or extremely formal sense, unless explicitly defined herein.

Techniques, methods and apparatuses known to those having ordinary skills in the art may not be discussed herein in detail, but, where appropriate, those techniques, methods and apparatuses shall be considered as a part of the specification.

Example 1

As shown in FIGS. 1 to 12, the present technical scheme provides a downhole closed-loop anti-tilting tool, which comprises:

- a housing, with two ends that can be connected with a drill stem and a drill bit respectively;
- a rotating impeller 7 that is arranged in the housing and can be driven by the drilling fluid to rotate;
- a hydraulic pump 16 that is arranged in the housing and connected in transmission to the rotating impeller 7;
- recessed parts circumferentially arranged at intervals on an outer circumference of the housing;
- a plunger 42 movably arranged in the recessed parts and a push plate 44 arranged on an outer surface of the plunger 42;
- a plurality of hydraulic flow paths circumferentially arranged at intervals in the housing, the plurality of hydraulic flow paths respectively communicating the hydraulic pump 16 and each recessed part;
- and an eccentric flow dividing disc 26 disposed on the plurality of hydraulic flow paths, an outer circumference of the eccentric flow dividing disc being provided with a notch allowing one of the hydraulic flow paths to be communicated, the center of gravity and the notch of the eccentric flow dividing disc 26 being respectively located on two sides of a central axis, and the eccentric flow dividing disc 26 being capable of rotating around the central axis;
- wherein when the housing is inclined, the eccentric flow dividing disc 26 rotates to a state in which the notch is located at a higher position and the center of gravity is located at a lower position, so as to connect to one of the hydraulic flow paths and disconnect the other hydraulic flow paths, so that the plunger 42 and the push plate 44 corresponding to the connected hydraulic flow path are driven to move outward radially.

The main function of the downhole closed-loop anti-tilting tool is to prevent the drill bit from tilting lateral during drilling.

The housing is generally tubular, and is formed by a plurality of tubular structures connected together. During use, the housing is arranged to extend in the vertical direction, and when it is tilted, its central axis forms an included angle with respect to the vertical direction.

The rotating impeller 7 is coaxially arranged in the housing, and can rotate under the action of the drilling fluid flowing through the housing, thereby it transmits the torque to the hydraulic pump 16 to drive the hydraulic pump 16 to operate, and the hydraulic pump 16 can transfer the hydraulic oil to the hydraulic flow path to act on the plunger 42 by means of the hydraulic oil.

The plunger 42 and the push plate 44 are arranged in the recessed parts on the outer circumference of the housing, and can move radially under the action of the hydraulic oil, so that the push plate 44 protrudes to be supported on the wall of the drilled well.

When the drill pipe or drill bit is tilted, the housing is also titled, for example, it is tilted in a first direction. Owing to the tilting of the housing, the central axis of the eccentric flow dividing disc 26 also forms a tilt angle with respect to the vertical axis, and the center of gravity of the eccentric flow dividing disc 26 is eccentrically arranged, so that the eccentric flow dividing disc 26 rotates under the action of gravity, and its center of gravity is at a lower position, while the notch is at a higher position (relatively far from the center of gravity) and is also in the first direction. The notch communicates with the corresponding hydraulic flow path, so that the plunger 42 in the first direction moves radially outward under the pressure of the hydraulic oil, thereby pushes the push plate 44 to extend out to be supported on the wall of the drilled well, while the other push plates 44 do not extend out; thus, the housing returns to the non-tilted position in which the central axis extends vertically under the action of the extending push plate 44.

For example, when the drill pipe or drill bit is tilted eastward, the center of gravity of the eccentric flow dividing disc 26 rotates to the west of the central axis, and the notch rotates to the east of the central axis to communicate with the hydraulic flow path at the east side, so that the plunger 42 and the push plate 44 extend outward and are supported on the wall of the drilled wall, thereby the housing and the drill pipe or drill bit move westward under the reaction force of the wall of the drilled well, and the tilted state is corrected.

In the present scheme, the downhole high-pressure fluid is distributed and the plunger action is controlled by means of the automatic rotation of the downhole eccentric flow dividing disc under the action of gravity, so as to realize closed-loop automatic operation; different from existing integrated electromechanical anti-tilting tools, the entire tool set has no electronic component, is not subjected to temperature limitation, and can fully adapt to normal temperature, high temperature and ultra-high temperature well environments; besides, the manufacturing cost of the tool is greatly reduced since electronic components are reduced; the downhole closed-loop anti-tilting tool has the characteristics of low cost and convenient maintenance while meeting downhole closed-loop anti-tilting requirements during drilling.

The downhole closed-loop anti-tilting tool further comprises a nonmagnetic outer cylinder 10 and a driving shaft 6 that is rotatably arranged in the nonmagnetic outer cylinder 10 and connected in transmission to the hydraulic pump 16, wherein the rotating impeller 7 is rotatably sleeved on the nonmagnetic outer cylinder 10, and the driving shaft 6 is magnetically coupled with the rotating impeller 7. The nonmagnetic outer cylinder 10 is used to isolate the hydraulic pump 16, the driving shaft 6 and the rotating impeller 7, so as to better protect the hydraulic pump 16 and the driving shaft 6 and avoid or reduce the impact of the drilling fluid on the hydraulic pump 16 and the driving shaft 6. The driving shaft 6 may be made of a magnetic material or have magnets embedded therein; similarly, the rotating impeller 7 may be made of a magnetic material or have magnets embedded therein; the driving shaft 6 and the rotating impeller 7 are magnetically coupled with each other, and the rotating impeller 7 also magnetically acts on the driving shaft 6 to drive the driving shaft 6 to rotate while it rotates. The driving shaft 6 is coaxially connected to the hydraulic pump 16 to transmit the torque to the hydraulic pump 16.

The upper end of the non-magnetic outer cylinder 10 is connected with a conical-head rod 2, and the upper end of the conical-head rod 2 is formed in a conical shape to guide the drilling fluid to flow to the periphery of the upper end, so that the impact acts on the rotating impeller 7; the conical-head rod 2 is a stepped shaft that has four rubber ribs vulcanized at the step, so as to be fitted with the inner circumferential surface of the housing (e.g., the upper outer cylinder 1). The low end of the conical-head rod 2 is provided with threads, so as to be connected with the nonmagnetic outer cylinder 10 through the threads.

An upper inner alloy ring 4 is sleeved on the upper part of the nonmagnetic outer cylinder 10 and a lower inner alloy ring 9 is sleeved on the lower part of the nonmagnetic outer cylinder 10; an upper outer alloy ring 5 rotatably sleeved on the upper inner alloy ring 4 is sleeved on the upper end of the rotating impeller 7 and a lower outer alloy ring 8 rotatably sleeved on the lower inner alloy ring 9 is sleeved on the lower end of the rotating impeller 7 to form a structure similar to a bearing, so that the rotating impeller 7 is rotatably arranged on the outer circumference of the nonmagnetic outer cylinder 10.

The upper end of the driving shaft 6 is mounted on the nonmagnetic outer cylinder 10 via a sliding bearing 3, and the lower end of the driving shaft 6 is mounted on the nonmagnetic outer cylinder 10 via a lower bearing 11.

The nonmagnetic outer cylinder 10 is a part with threads on two ends, the lower end of the nonmagnetic outer cylinder 10 is connected with an adapter 15 through threads, the rotating impeller 7 is sleeved on the step on the outer circumference, and the sliding bearing 3, the driving shaft 6 and the lower bearing 11 are mounted in the internal hole. The inner race of the sliding bearing 3 is sleeved on the driving shaft 6, and the outer race of the sliding bearing 3 is sleeved on the nonmagnetic outer cylinder 10. The outer race of the low bearing 11 is sleeved on the nonmagnetic outer cylinder 10, and the inner race of the lower bearing 11 is sleeved on the driving shaft 6. The driving shaft 6 is a magnetic part with a surface electrochemically coated with magnetic powder. A square hole is formed in one end face of the drilling shaft 6 for receiving the hydraulic pump 16, and a disc spring 12 and a compression rubber spring 13 are sleeved on the outer circumference of the drilling shaft 6; one end face of the disc spring 12 is engaged with a boss end face of the driving shaft 6, and the other end face of the disc spring 12 is engaged with the compression rubber spring 13, and the disc spring 13 is compressed when the nonmagnetic outer cylinder 10 is connected with the adapter 15 through threads. The adapter 15 is partially sleeved on the upper end of the hydraulic pump 16 and connected to the hydraulic pump 16 by screws 14. In addition, a commutation connector 18 connected to the adapter 15 is sleeved on the lower end of the hydraulic pump 16, and the adapter 15 and the commutation connector 18 form a seal at the lower end of the nonmagnetic outer cylinder 10, thereby a sealed space is formed inside the nonmagnetic outer cylinder 10.

Figure 2:
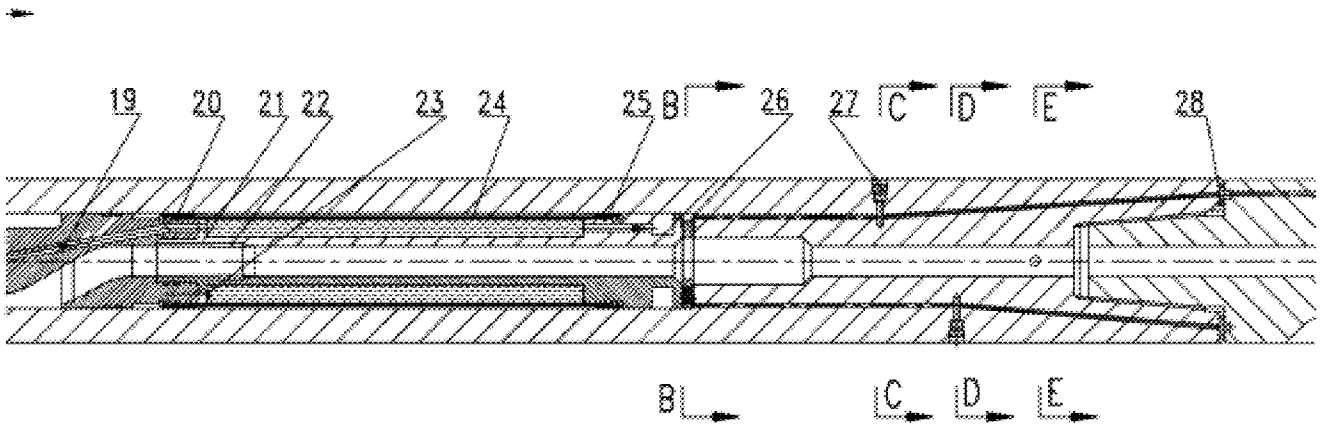
Figure 3:
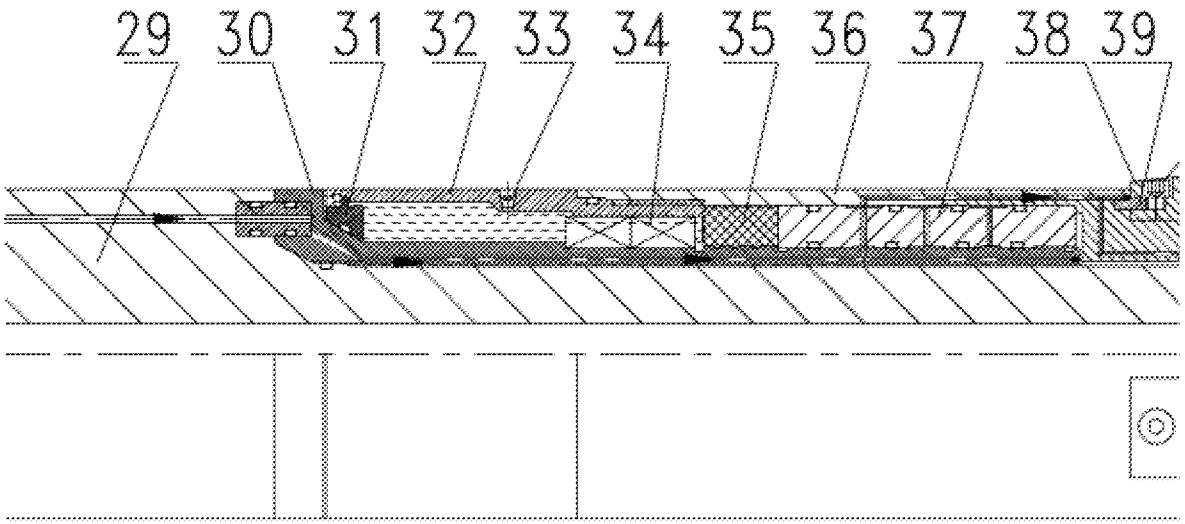
Figure 4:
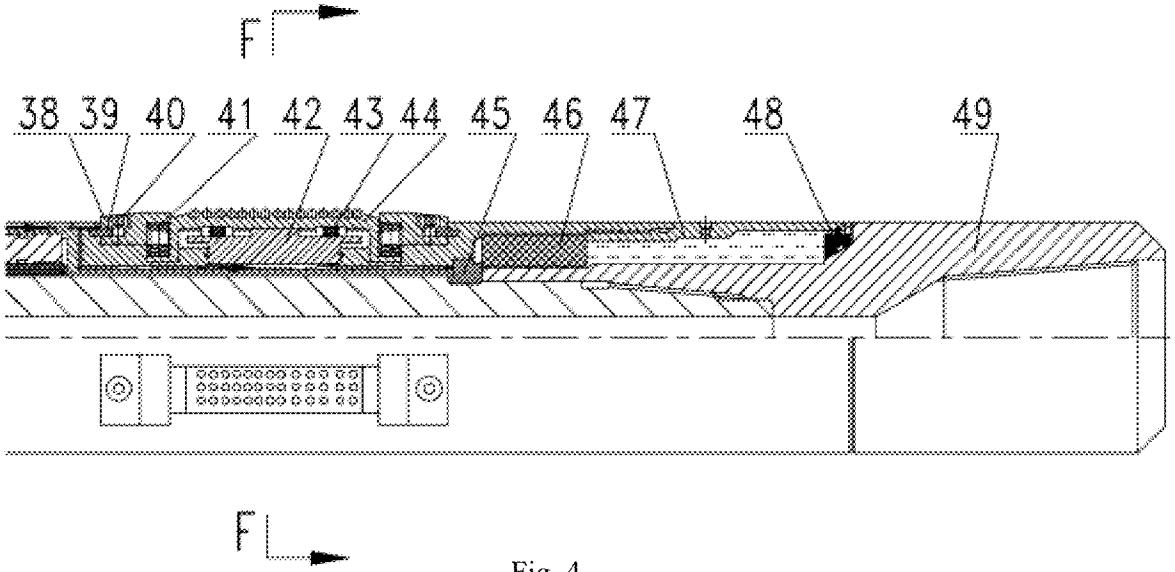
Figure 5:
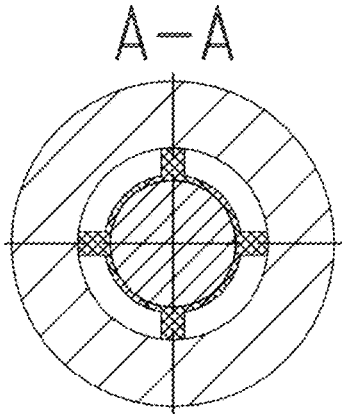
FIGS. 5 to 10 show cross sections perpendicular to the central axis at various positions in FIGS. 1 to 4, respectively.
Figure 6:
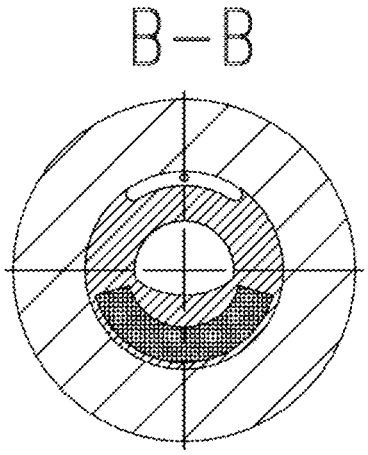
Figure 7:
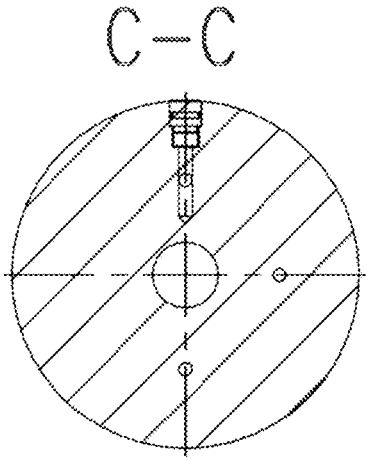
Figure 8:
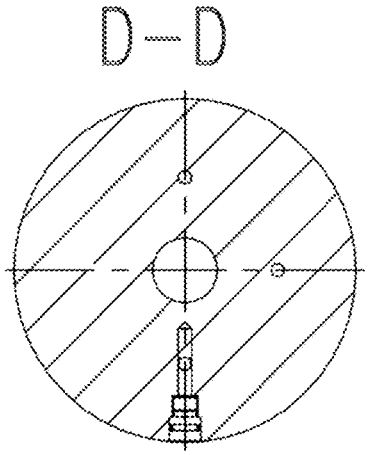
Figure 9:
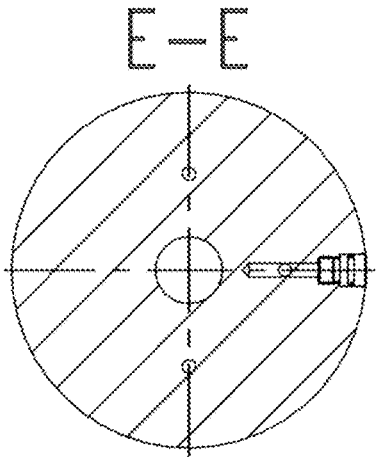
Figure 10:
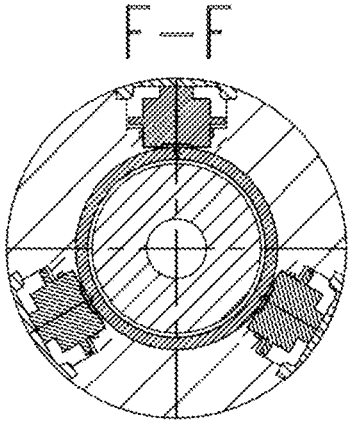

The housing comprises an upper outer cylinder 1, an oil storage cylinder 21 and a rubber sleeve 24 sleeved on the oil storage cylinder 21 are arranged in the upper outer cylinder 1, an annular hydraulic oil cavity is formed between the rubber sleeve 24 and the oil storage cylinder 21, and the hydraulic oil cavity is in communication with each of the hydraulic flow paths. As shown in FIG. 2, the two ends of the oil storage cylinder 21 have greater outer diameters, an annular groove is formed on the outer circumference of the middle part of the oil storage cylinder 21, and a hydraulic oil cavity is formed between the middle part and the rubber sleeve 24, and a certain volume of hydraulic oil can be stored in the hydraulic oil cavity, so that the hydraulic pump 16 can transfer the hydraulic oil to the corresponding recessed part and act on the plunger 42. Oil passages are formed in two end portions of the oil storage cylinder 21, so that the oil path communicates with other structures on the upper and lower sides of the oil storage cylinder 21 respectively.

An anti-impact sleeve 22 is embedded in the internal hole at the left end of the oil storage cylinder 21, and the anti-impact sleeve 22 is a cylindrical part with a tapered internal hole. Annular grooves are formed on the outer circumferences of the two ends of the oil storage cylinder 21, annular protrusions are formed on the inner circumferences of the two ends of the rubber sleeve 24, and the annular protrusions are respectively accommodated in the two annular grooves; an upper fixed sleeve 20 and a lower fixed sleeve 25 are sleeved on the two ends of the rubber sleeve 24 respectively to press the rubber sleeve 24 firmly on the oil storage cylinder 21.

An annular step is formed in the lower part of the upper outer cylinder 1, and the annular step is provided with a plurality of inlets corresponding to the hydraulic flow paths; the eccentric flow dividing disc 26 is arranged between the lower end of the oil storage cylinder 21 and the annular step, and there is certain clearance between the eccentric flow dividing disc 26 and the oil storage cylinder 21 and the annular step, so that a small amount of hydraulic oil can pass through the clearance into the central hole of the upper outer cylinder 1. When the housing returns from the tilted state to the vertical state, the push plate 44 and the plunger 42 that extended out originally move radially inward under the action of the wall of the drilled well, so that the hydraulic oil returns along the hydraulic flow path. At that point, since the eccentric flow dividing disc 26 is in a non-tilted state, it may not rotate in a wide range than before, and the hydraulic oil can return to the hydraulic oil cavity via the notch; if the notch has been staggered, the hydraulic oil can flow into the central hole of the upper outer cylinder 1 through the clearance between the eccentric flow dividing disc 26 and the annular step of the upper outer cylinder 1.

In addition, a pump end connector 17, a commutation connector 18 and a bypass connector 19 are arranged between the hydraulic pump 16 and the oil storage cylinder 21, and the hydraulic pump 16 and the oil storage cylinder 21 are in communication with each other through a main flow path arranged in the pump end connector 17, the commutation connector 18 and the bypass connector 19. The pump end connector 17, the commutation connector 18 and the bypass connector 19 can be provided with a section of main flow path respectively so that the hydraulic pump 16 communicates with the oil passages in the oil storage cylinder 21. As shown in FIG. 2, the bypass connector 19 is provided with a central hole, and the central hole communicates in bypass with the surrounding annular space via a radial through-hole, so as to allow the drilling fluid in the annular space to flow into the bypass connector 19 and further flow downwards. The bypass connector 19 is internally provided with elongated channels, one of which is a high-pressure oil output channel and the other is a low-pressure oil return channel, and two ends of the high-pressure oil output channel and the low-pressure oil return channel respectively communicate with the commutation connector 18 and the oil storage cylinder 21.

In addition, the hydraulic flow path is arranged partially in a part of the upper outer cylinder 1, and a radial blind hole communicating with the hydraulic flow path is arranged in the upper outer cylinder 1, and the radial blind hole is sealed by a sealing plug 27.

Moreover, the downhole closed-loop anti-tilting tool further comprises a central axle 29 connected to the lower end of the upper outer cylinder 1, and a lower outer cylinder 36 rotatably sleeved on the central axle 29, and the lower outer cylinder 36 is provided with the recessed part. The hydraulic flow path is partially arranged in the central axle 29, and a rectangular ring 28 surrounding the hydraulic flow path is arranged between the central axle 29 and the upper outer cylinder 1 to improve the sealing effect. The lower outer cylinder 36 can rotate with respect to the central axle 29, so as to allow the push plate 44 to rotate with respect to the upper outer cylinder 1 and the central axle 29, and avoid the jamming of the downhole closed-loop anti-tilting tool when the downhole closed-loop anti-tilting tool rotates following the rotation of the drill pipe.

In addition, the downhole closed-loop anti-tilting tool further comprises an inner sleeve 30 fixedly sleeved on the central axle 29 and an upper oil seal housing 32 rotatably sleeved on the inner sleeve 30 via a sleeve bearing 34, wherein an upper end of the lower outer cylinder 36 is fixedly sleeved on the upper oil seal housing 32, and the hydraulic flow paths are provided in the central axle 29, the inner sleeve 30, and the lower outer cylinder 36. The inner sleeve 30 is connected to the lower outer cylinder 26, the upper oil seal housing 32 is connected to the central axle 29, and a sleeve bearing 34 is arranged between the inner sleeve 30 and the upper oil seal housing 32 to realize the rotation between them.

An upper lubricating oil cavity at an upper side of the sleeve bearing 34 is formed between the upper oil seal housing 32 and the inner sleeve 30. A seal ring groove is formed in an inner bevel surface of the inner sleeve 30, and a seal ring is mounted in the seal ring groove. An upper oil seal ring 31 and an upper oil seal housing 32 are mounted on the outer circumference of the inner sleeve 30. The upper oil seal ring 31, the upper oil seal housing 32, the inner sleeve 30 and the oil-separating rubber ring 35 form an upper lubricating oil cavity, and lubricating oil is filled in the upper lubricating oil cavity through a tapered hole (sealed by a tapered plug 33) in the upper oil seal housing 32 to provide lubrication for the sleeve bearing 34.

A flow-dividing ring 37 is arranged between the upper oil seal housing 32 and the lower outer cylinder 36, a plurality of radial flow paths arranged axially at intervals are provided in the flow-dividing ring 37, and the plurality of radial flow paths are in communication with each of the hydraulic flow paths in one-to-one alignment. Radial flow paths in the flow dividing ring 37 respectively communicate with each of the hydraulic flow paths in the inner sleeve 30 and each of the hydraulic flow paths in the lower outer cylinder 36.

Stop blocks 38 are respectively provided at an upper end and a lower end of the recessed part, and a radially retractable stop spring 41 is provided between the stop block 38 and the push plate 44; and/or a composite spring 43 is provided between the push plate 44 and the plunger 42. The stop block 38 is a square part, and is connected with an orifice plate 39 by bolts 40, and the orifice plate 39 is inserted into the stepped inner groove of the lower outer cylinder 36. A stop spring 41 is mounted between the stop block 38 and the push plate 44. There are two groups of stop blocks 38, stop springs 41, orifice plates 39 and bolts 40, which are respectively installed at the two ends of the push plate 44. The push plate 44 is a strip-shaped part that has a super-hard material such as PDC or cemented carbide embedded in the surface and a square groove inside, with the two ends extending out, and realizes a stop function by means of the stop spring 41, the stop block 38 or the like.

The plunger 42 is a rectangular boss part mounted in the recessed part in the lower outer cylinder 36; the top surface of the plunger 42 abuts against the push plate 44, and the bottom surface of the plunger 42 communicates with the hydraulic flow paths of the lower outer cylinder 36; composite springs 43 are mounted between the two sides of the top surface of the plunger 42 and the push plate 44. The composite spring 43 is an elastic combination of a columnar rubber piece and a compression spring, and is used to stably push the push plate 44 to move.

The lower end of the central axle 29 is connected with a lower connector 49, a lower oil seal housing 47 is sleeved on the upper part of the lower connector 49, and a lower lubricating oil cavity is formed between the lower oil seal housing 47 and the lower connector 49. The lower oil seal housing 47 is a T-shaped cylindrical part, with a tapered threaded hole formed radially in the outer circumference, and a tapered hole is formed in the tapered threaded hole. A sealing rubber ring 46, the lower oil seal housing 47 and the oil seal ring 48 are sleeved on the outer circumference of the lower connector 49 to form a sealed cavity, and lubricating oil is filled in the cavity through the tapered hole in the lower oil seal housing 47. The oil seal ring 48 is a part that has a seal ring groove formed in an inner bevel surface and a seal ring mounted in the seal ring groove, and the inner bevel surface abuts against the bevel surface of the lower connector 49. The lower connector 49 is a connector with threads on two ends, wherein the left end is connected to the central axle 29 through threads, and the end face abuts against an anti-drop ring 45 to limit the anti-drop ring 45.

Figure 11:
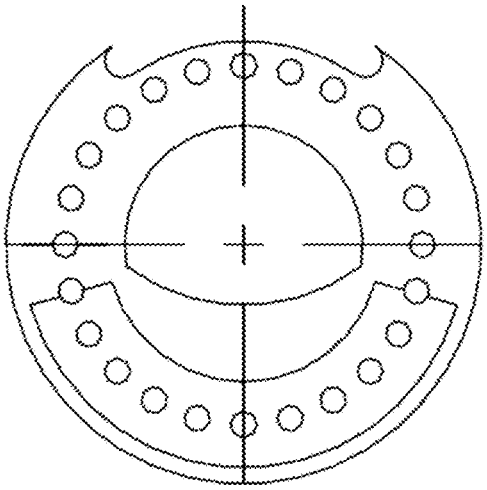
FIG. 11 is a schematic structural view of the eccentric flow dividing disc according to the embodiments of the present scheme.
Figure 12:
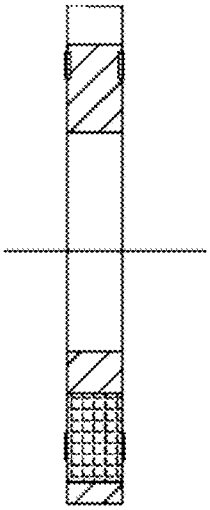
FIG. 12 is a cross-sectional view of the eccentric flow dividing disc according to the embodiments of the present scheme.

As shown in FIGS. 11 and 12, wear-resistant bosses are arranged on the two end faces of the eccentric flow dividing disc 26; and/or the eccentric flow dividing disc 26 is provided with an eccentric hole. Cylindrical cemented carbide blocks are embedded in the two side surfaces of the eccentric flow dividing disc 26 to form wear-resistant bosses, the cemented carbide block in one side contacts with the end surface of the oil storage cylinder 21, and cemented carbide block in the other side contacts with the cylindrical cemented carbide block on the inner stepped surface of the upper outer cylinder 1.

Example 2

As shown in FIGS. 1 to 12, the present technical scheme provides a downhole closed-loop anti-tilting tool, which comprises:

a housing, with two ends that can be connected with a drill stem and a drill bit respectively;

a rotating impeller 7 that is arranged in the housing and can be driven by the drilling fluid to rotate;

a hydraulic pump 16 that is arranged in the housing and connected in transmission to the rotating impeller 7;

recessed parts circumferentially arranged at intervals on an outer circumference of the housing;

a plunger 42 movably arranged in the recessed parts and a push plate 44 arranged on an outer surface of the plunger 42;

a plurality of hydraulic flow paths circumferentially arranged at intervals in the housing, the plurality of hydraulic flow paths respectively communicating the hydraulic pump 16 and each recessed part;

and an eccentric flow dividing disc 26 disposed on the plurality of hydraulic flow paths, an outer circumference of the eccentric flow dividing disc being provided with a notch allowing one of the hydraulic flow paths to be communicated, the center of gravity and the notch of the eccentric flow dividing disc 26 being respectively located on two sides of a central axis, and the eccentric flow dividing disc 26 being capable of rotating around the central axis;

wherein when the housing is inclined, the eccentric flow dividing disc 26 rotates to a state in which the notch is located at a higher position and the center of gravity is located at a lower position, so as to connect to one of the hydraulic flow paths and disconnect the other hydraulic flow paths, so that the plunger 42 and the push plate 44 corresponding to the connected hydraulic flow path are driven to move outward radially.

The main function of the downhole closed-loop anti-tilting tool is to prevent the drill bit from tilting lateral during drilling.

The housing is generally tubular, and is formed by a plurality of tubular structures connected together. During use, the housing is arranged to extend in the vertical direction, and when it is tilted, its central axis forms an included angle with respect to the vertical direction.

The rotating impeller 7 is coaxially arranged in the housing, and can rotate under the action of the drilling fluid flowing through the housing, thereby it transmits the torque to the hydraulic pump 16 to drive the hydraulic pump 16 to operate, and the hydraulic pump 16 can transfer the hydraulic oil to the hydraulic flow path to act on the plunger 42 by means of the hydraulic oil.

The plunger 42 and the push plate 44 are arranged in the recessed parts on the outer circumference of the housing, and can move radially under the action of the hydraulic oil, so that the push plate 44 protrudes to be supported on the wall of the drilled well.

When the drill pipe or drill bit is tilted, the housing is also titled, for example, it is tilted in a first direction. Owing to the tilting of the housing, the central axis of the eccentric flow dividing disc 26 also forms a tilt angle with respect to the vertical axis, and the center of gravity of the eccentric flow dividing disc 26 is eccentrically arranged, so that the eccentric flow dividing disc 26 rotates under the action of gravity, and its center of gravity is at a lower position, while the notch is at a higher position (relatively far from the center of gravity) and is also in the first direction. The notch communicates with the corresponding hydraulic flow path, so that the plunger 42 in the first direction moves radially outward under the pressure of the hydraulic oil, thereby pushes the push plate 44 to extend out to be supported on the wall of the drilled well, while the other push plates 44 do not extend out; thus, the housing returns to the non-tilted position in which the central axis extends vertically under the action of the extending push plate 44.

For example, when the drill pipe or drill bit is tilted eastward, the center of gravity of the eccentric flow dividing disc 26 rotates to the west of the central axis, and the notch rotates to the east of the central axis to communicate with the hydraulic flow path at the east side, so that the plunger 42 and the push plate 44 extend outward and are supported on the wall of the drilled wall, thereby the housing and the drill pipe or drill bit move westward under the reaction force of the wall of the drilled well, and the tilted state is corrected.

In the present scheme, the downhole high-pressure fluid is distributed and the plunger action is controlled by means of the automatic rotation of the downhole eccentric flow dividing disc under the action of gravity, so as to realize closed-loop automatic operation; different from existing integrated electromechanical anti-tilting tools, the entire tool set has no electronic component, is not subjected to temperature limitation, and can fully adapt to normal temperature, high temperature and ultra-high temperature well environments; besides, the manufacturing cost of the tool is greatly reduced since electronic components are reduced; the downhole closed-loop anti-tilting tool has the characteristics of low cost and convenient maintenance while meeting downhole closed-loop anti-tilting requirements during drilling.

The downhole closed-loop anti-tilting tool further comprises a nonmagnetic outer cylinder 10 and a driving shaft 6 that is rotatably arranged in the nonmagnetic outer cylinder 10 and connected in transmission to the hydraulic pump 16, wherein the rotating impeller 7 is rotatably sleeved on the nonmagnetic outer cylinder 10, and the driving shaft 6 is magnetically coupled with the rotating impeller 7. The nonmagnetic outer cylinder 10 is used to isolate the hydraulic pump 16, the driving shaft 6 and the rotating impeller 7, so as to better protect the hydraulic pump 16 and the driving shaft 6 and avoid or reduce the impact of the drilling fluid on the hydraulic pump 16 and the driving shaft 6. The driving shaft 6 may be made of a magnetic material or have magnets embedded therein; similarly, the rotating impeller 7 may be made of a magnetic material or have magnets embedded therein; the driving shaft 6 and the rotating impeller 7 are magnetically coupled with each other, and the rotating impeller 7 also magnetically acts on the driving shaft 6 to drive the driving shaft 6 to rotate while it rotates. The driving shaft 6 is coaxially connected to the hydraulic pump 16 to transmit the torque to the hydraulic pump 16.

The upper end of the non-magnetic outer cylinder 10 is connected with a conical-head rod 2, and the upper end of the conical-head rod 2 is formed in a conical shape to guide the drilling fluid to flow to the periphery of the upper end, so that the impact acts on the rotating impeller 7; the conical-head rod 2 is a stepped shaft that has four rubber ribs vulcanized at the step, so as to be fitted with the inner circumferential surface of the housing (e.g., the upper outer cylinder 1). The low end of the conical-head rod 2 is provided with threads, so as to be connected with the nonmagnetic outer cylinder 10 through the threads.

An upper inner alloy ring 4 is sleeved on the upper part of the nonmagnetic outer cylinder 10 and a lower inner alloy ring 9 is sleeved on the lower part of the nonmagnetic outer cylinder 10; an upper outer alloy ring 5 rotatably sleeved on the upper inner alloy ring 4 is sleeved on the upper end of the rotating impeller 7 and a lower outer alloy ring 8 rotatably sleeved on the lower inner alloy ring 9 is sleeved on the lower end of the rotating impeller 7 to form a structure similar to a bearing, so that the rotating impeller 7 is rotatably arranged on the outer circumference of the nonmagnetic outer cylinder 10.

The upper end of the driving shaft 6 is mounted on the nonmagnetic outer cylinder 10 via a sliding bearing 3, and the lower end of the driving shaft 6 is mounted on the nonmagnetic outer cylinder 10 via a lower bearing 11.

The nonmagnetic outer cylinder 10 is a part with threads on two ends, the lower end of the nonmagnetic outer cylinder 10 is connected with an adapter 15 through threads, the rotating impeller 7 is sleeved on the step on the outer circumference, and the sliding bearing 3, the driving shaft 6 and the lower bearing 11 are mounted in the internal hole. The inner race of the sliding bearing 3 is sleeved on the driving shaft 6, and the outer race of the sliding bearing 3 is sleeved on the nonmagnetic outer cylinder 10. The outer race of the low bearing 11 is sleeved on the nonmagnetic outer cylinder 10, and the inner race of the lower bearing 11 is sleeved on the driving shaft 6. The driving shaft 6 is a magnetic part with a surface electrochemically coated with magnetic powder. A square hole is formed in one end face of the drilling shaft 6 for receiving the hydraulic pump 16, and a disc spring 12 and a compression rubber spring 13 are sleeved on the outer circumference of the drilling shaft 6; one end face of the disc spring 12 is engaged with a boss end face of the driving shaft 6, and the other end face of the disc spring 12 is engaged with the compression rubber spring 13, and the disc spring 13 is compressed when the nonmagnetic outer cylinder 10 is connected with the adapter 15 through threads. The adapter 15 is partially sleeved on the upper end of the hydraulic pump 16 and connected to the hydraulic pump 16 by screws 14. In addition, a commutation connector 18 connected to the adapter 15 is sleeved on the lower end of the hydraulic pump 16, and the adapter 15 and the commutation connector 18 form a seal at the lower end of the nonmagnetic outer cylinder 10, thereby a sealed space is formed inside the nonmagnetic outer cylinder 10.

The housing comprises an upper outer cylinder 1, a tubular oil storage structure is arranged in the upper outer cylinder 1, an annular hydraulic oil cavity is formed in the oil storage structure, and the hydraulic oil cavity communicates with each of the hydraulic flow paths. The oil storage structure may be composed of an inner tube, an outer tube and annular end plates at two ends.

An annular step is formed on a lower part of the upper outer cylinder 1, inlets corresponding to the plurality of hydraulic flow paths are arranged on the annular step, and the eccentric flow dividing disc 26 is arranged between a lower end of the oil storage cylinder 21 and the annular step. There is certain clearance between the eccentric flow dividing disc 26 and the oil storage cylinder 21 and the annular step, so as to allow a small amount of hydraulic oil to pass through the clearance into the central hole of the upper outer cylinder 1. When the housing returns from the tilted state to the vertical state, the push plate 44 and the plunger 42 that extended out originally move radially inward under the action of the wall of the drilled well, so that the hydraulic oil returns along the hydraulic flow path. At that point, since the eccentric flow dividing disc 26 is in a non-tilted state, it may not rotate in a wide range than before, and the hydraulic oil can return to the hydraulic oil cavity via the notch; if the notch has been staggered, the hydraulic oil can flow into the central hole of the upper outer cylinder 1 through the clearance between the eccentric flow dividing disc 26 and the annular step of the upper outer cylinder 1.

In addition, a pump end connector 17, a commutation connector 18 and a bypass connector 19 are arranged between the hydraulic pump 16 and the oil storage cylinder 21, and the hydraulic pump 16 and the oil storage cylinder 21 are in communication with each other through a main flow path arranged in the pump end connector 17, the commutation connector 18 and the bypass connector 19. The pump end connector 17, the commutation connector 18 and the bypass connector 19 can be provided with a section of main flow path respectively so that the hydraulic pump 16 communicates with the oil passages in the oil storage cylinder 21. As shown in FIG. 2, the bypass connector 19 is provided with a central hole, and the central hole communicates in bypass with the surrounding annular space via a radial through-hole, so as to allow the drilling fluid in the annular space to flow into the bypass connector 19 and further flow downwards. The bypass connector 19 is internally provided with elongated channels, one of which is a high-pressure oil output channel and the other is a low-pressure oil return channel, and two ends of the high-pressure oil output channel and the low-pressure oil return channel respectively communicate with the commutation connector 18 and the oil storage cylinder 21.

In addition, the hydraulic flow path is arranged partially in a part of the upper outer cylinder 1, and a radial blind hole communicating with the hydraulic flow path is arranged in the upper outer cylinder 1, and the radial blind hole is sealed by a sealing plug 27.

Moreover, the downhole closed-loop anti-tilting tool further comprises a central axle 29 connected to the lower end of the upper outer cylinder 1, and a lower outer cylinder 36 rotatably sleeved on the central axle 29, and the lower outer cylinder 36 is provided with the recessed part. The hydraulic flow path is partially arranged in the central axle 29, and a rectangular ring 28 surrounding the hydraulic flow path is arranged between the central axle 29 and the upper outer cylinder 1 to improve the sealing effect. The lower outer cylinder 36 can rotate with respect to the central axle 29, so as to allow the push plate 44 to rotate with respect to the upper outer cylinder 1 and the central axle 29, and avoid the jamming of the downhole closed-loop anti-tilting tool when the downhole closed-loop anti-tilting tool rotates following the rotation of the drill pipe.

In addition, the downhole closed-loop anti-tilting tool further comprises an inner sleeve 30 fixedly sleeved on the central axle 29 and an upper oil seal housing 32 rotatably sleeved on the inner sleeve 30 via a sleeve bearing 34, wherein an upper end of the lower outer cylinder 36 is fixedly sleeved on the upper oil seal housing 32, and the hydraulic flow paths are provided in the central axle 29, the inner sleeve 30, and the lower outer cylinder 36. The inner sleeve 30 is connected to the lower outer cylinder 26, the upper oil seal housing 32 is connected to the central axle 29, and a sleeve bearing 34 is arranged between the inner sleeve 30 and the upper oil seal housing 32 to realize the rotation between them.

An upper lubricating oil cavity at an upper side of the sleeve bearing 34 is formed between the upper oil seal housing 32 and the inner sleeve 30. A seal ring groove is formed in an inner bevel surface of the inner sleeve 30, and a seal ring is mounted in the seal ring groove. An upper oil seal ring 31 and an upper oil seal housing 32 are mounted on the outer circumference of the inner sleeve 30. The upper oil seal ring 31, the upper oil seal housing 32, the inner sleeve 30 and the oil-separating rubber ring 35 form an upper lubricating oil cavity, and lubricating oil is filled in the upper lubricating oil cavity through a tapered hole (sealed by a tapered plug 33) in the upper oil seal housing 32 to provide lubrication for the sleeve bearing 34.

A flow-dividing ring 37 is arranged between the upper oil seal housing 32 and the lower outer cylinder 36, a plurality of radial flow paths arranged axially at intervals are provided in the flow-dividing ring 37, and the plurality of radial flow paths are in communication with each of the hydraulic flow paths in one-to-one alignment. Radial flow paths in the flow dividing ring 37 respectively communicate with each of the hydraulic flow paths in the inner sleeve 30 and each of the hydraulic flow paths in the lower outer cylinder 36.

Stop blocks 38 are respectively provided at an upper end and a lower end of the recessed part, and a radially retractable stop spring 41 is provided between the stop block 38 and the push plate 44; and/or a composite spring 43 is provided between the push plate 44 and the plunger 42. The stop block 38 is a square part, and is connected with an orifice plate 39 by bolts 40, and the orifice plate 39 is inserted into the stepped inner groove of the lower outer cylinder 36. A stop spring 41 is mounted between the stop block 38 and the push plate 44. There are two groups of stop blocks 38, stop springs 41, orifice plates 39 and bolts 40, which are respectively installed at the two ends of the push plate 44. The push plate 44 is a strip-shaped part that has a super-hard material such as PDC or cemented carbide embedded in the surface and a square groove inside, with the two ends extending out, and realizes a stop function by means of the stop spring 41, the stop block 38 or the like.

The plunger 42 is a rectangular boss part mounted in the recessed part in the lower outer cylinder 36; the top surface of the plunger 42 abuts against the push plate 44, and the bottom surface of the plunger 42 communicates with the hydraulic flow paths of the lower outer cylinder 36; composite springs 43 are mounted between the two sides of the top surface of the plunger 42 and the push plate 44. The composite spring 43 is an elastic combination of a columnar rubber piece and a compression spring, and is used to stably push the push plate 44 to move.

The lower end of the central axle 29 is connected with a lower connector 49, a lower oil seal housing 47 is sleeved on the upper part of the lower connector 49, and a lower lubricating oil cavity is formed between the lower oil seal housing 47 and the lower connector 49. The lower oil seal housing 47 is a T-shaped cylindrical part, with a tapered threaded hole formed radially in the outer circumference, and a tapered hole is formed in the tapered threaded hole. A sealing rubber ring 46, the lower oil seal housing 47 and the oil seal ring 48 are sleeved on the outer circumference of the lower connector 49 to form a sealed cavity, and lubricating oil is filled in the cavity through the tapered hole in the lower oil seal housing 47. The oil seal ring 48 is a part that has a seal ring groove formed in an inner bevel surface and a seal ring mounted in the seal ring groove, and the inner bevel surface abuts against the bevel surface of the lower connector 49. The lower connector 49 is a connector with threads on two ends, wherein the left end is connected to the central axle 29 through threads, and the end face abuts against an anti-drop ring 45 to limit the anti-drop ring 45.

As shown in FIGS. 11 and 12, wear-resistant bosses are arranged on the two end faces of the eccentric flow dividing disc 26; and/or the eccentric flow dividing disc 26 is provided with an eccentric hole. Cylindrical cemented carbide blocks are embedded in the two side surfaces of the eccentric flow dividing disc 26 to form wear-resistant bosses, the cemented carbide block in one side contacts with the end surface of the oil storage cylinder 21, and cemented carbide block in the other side contacts with the cylindrical cemented carbide block on the inner stepped surface of the upper outer cylinder 1.

So far, various embodiments of the present disclosure have been described in detail. Some details well known in the art are not described, in order to avoid obscuring the concept of the present disclosure. Those skilled in the art can fully understand how to implement the technical scheme disclosed herein according to the above description.

When some particular embodiments of the present disclosure have been described in detail above in examples, those skilled in the art may understand that the above examples are provided only for the purpose of description rather than limiting the scope of the present disclosure. Those skilled in the art may understand that various modifications can be made to the above embodiments or equivalent replacements can be made to some technical features without departing from the scope and spirit of the present disclosure. Especially, the technical features mentioned in the embodiments can be combined in any way, as long as there is no structural confliction.

The invention claimed is:

1. A downhole closed-loop anti-tilting tool, comprising:

a housing, with two ends that can be connected with a drill stem and a drill bit respectively;

a rotating impeller that is arranged in the housing and can be driven by the drilling fluid to rotate;

a hydraulic pump that is arranged in the housing and connected in transmission to the rotating impeller;

recessed parts circumferentially arranged at intervals on an outer circumference of the housing;

a plunger movably arranged in the recessed parts and a push plate arranged on an outer surface of the plunger;

a plurality of hydraulic flow paths circumferentially arranged at intervals in the housing, the plurality of hydraulic flow paths respectively communicating the hydraulic pump and each recessed part;

and an eccentric flow dividing disc disposed on the plurality of hydraulic flow paths, an outer circumference of the eccentric flow dividing disc being provided with a notch allowing one of the hydraulic flow paths to be communicated, the center of gravity and the notch of the eccentric flow dividing disc being respectively located on two sides of a central axis of the eccentric flow dividing disc, and the eccentric flow dividing disc being capable of rotating around the central axis;

wherein when the housing is inclined, the eccentric flow dividing disc rotates to a state in which the notch is located at a higher position and the center of gravity is located at a lower position, so as to connect to one of the hydraulic flow paths and disconnect the other hydraulic flow paths, so that the plunger and the push plate corresponding to the connected hydraulic flow path are driven to move outward radially.

2. The downhole closed-loop anti-tilting tool of claim 1, further comprising a nonmagnetic outer cylinder and a driving shaft that is rotatably arranged in the nonmagnetic outer cylinder and connected in transmission to the hydraulic pump, wherein the rotating impeller is rotatably sleeved on the nonmagnetic outer cylinder, and the driving shaft is magnetically coupled to the rotating impeller.

3. The downhole closed-loop anti-tilting tool of claim 2, wherein an upper end of the nonmagnetic outer cylinder is connected with a conical-head rod.

4. The downhole closed-loop anti-tilting tool of claim 2, wherein an upper inner alloy ring is sleeved on an upper part of the nonmagnetic outer cylinder and a lower inner alloy ring is sleeved on a lower part of the nonmagnetic outer cylinder; an upper outer alloy ring that can be rotatably sleeved on the upper inner alloy ring is provided at an upper end of the rotating impeller and a lower outer alloy ring that can be rotatably sleeved on the lower inner alloy ring is provided at the lower end of the rotating impeller.

5. The downhole closed-loop anti-tilting tool of claim 2, wherein an upper end of the driving shaft is mounted on the nonmagnetic outer cylinder via a sliding bearing, and a lower end of the driving shaft is mounted on the nonmagnetic outer cylinder via a lower bearing.

6. The downhole closed-loop anti-tilting tool of claim 1, wherein the housing comprises an upper outer cylinder, an oil storage cylinder and a rubber sleeve sleeved on the oil storage cylinder are arranged in the upper outer cylinder, an annular hydraulic oil cavity is formed between the rubber sleeve and the oil storage cylinder, and the hydraulic oil cavity is in communication with each of the hydraulic flow paths.

7. The downhole closed-loop anti-tilting tool of claim 6, wherein an annular step is formed on a lower part of the upper outer cylinder, inlets corresponding to the plurality of hydraulic flow paths are arranged on the annular step, and the eccentric flow dividing disc is arranged between a lower end of the oil storage cylinder and the annular step.

8. The downhole closed-loop anti-tilting tool of claim 6, wherein a pump end connector, a commutation connector and a bypass connector are arranged between the hydraulic pump and the oil storage cylinder, and the hydraulic pump and the oil storage cylinder are in communication with each other through a main flow path arranged in the pump end connector, the commutation connector and the bypass connector.

9. The downhole closed-loop anti-tilting tool of claim 6, further comprising a central axle connected to the lower end of the upper outer cylinder and a lower outer cylinder rotatably sleeved on the central axle, wherein the lower outer cylinder is provided with the recessed part.

10. The downhole closed-loop anti-tilting tool of claim 9, further comprising an inner sleeve fixedly sleeved on the central axle and an upper oil seal housing rotatably sleeved on the inner sleeve via a sleeve bearing, wherein an upper end of the lower outer cylinder is fixedly sleeved on the upper oil seal housing, and the hydraulic flow paths are arranged in the central axle, the inner sleeve and the lower outer cylinder respectively.

11. The downhole closed-loop anti-tilting tool of claim 10, wherein an upper lubricating oil cavity at an upper side of the sleeve bearing is formed between the upper oil seal housing and the inner sleeve.

12. The downhole closed-loop anti-tilting tool of claim 10, wherein a flow-dividing ring is arranged between the upper oil seal housing and the lower outer cylinder, a plurality of radial flow paths arranged axially at intervals are provided in the flow-dividing ring, and the plurality of radial flow paths are in communication with each of the hydraulic flow paths in one-to-one alignment.

13. The downhole closed-loop anti-tilting tool of claim 10, wherein stop blocks are respectively provided at an upper end and a lower end of the recessed part, and a radially retractable stop spring is provided between the stop block and the push plate; and/or a composite spring is provided between the push plate and the plunger.

14. The downhole closed-loop anti-tilting tool of claim 9, wherein a lower end of the central axle is connected with a lower connector, a lower oil seal housing is sleeved on an upper part of the lower connector, and a lower lubricating oil cavity is formed between the lower oil seal housing and the lower connector.

15. The downhole closed-loop anti-tilting tool of claim 1, wherein wear-resistant bosses are arranged on two end faces of the eccentric flow dividing disc; and/or the eccentric flow dividing disc is provided with an eccentric hole.

* * * * *